US005513782A

United States Patent [19]

Rosso

[11] Patent Number: 5,513,782

[45] Date of Patent: May 7, 1996

[54] DEVICE FOR REMOVING MERELY PARTIALLY TURNED STOCKINGS ON A STOCKING TURNING MACHINE

[75] Inventor: Pietro Rosso, Torino, Italy

[73] Assignee: Rosso Industrie S.p.A., Orbassano, Italy

[21] Appl. No.: 244,289

[22] PCT Filed: Sep. 29, 1993

[86] PCT No.: PCT/EP93/02643

§ 371 Date: May 23, 1994

§ 102(e) Date: May 23, 1994

[87] PCT Pub. No.: WO94/08084

PCT Pub. Date: Apr. 14, 1994

[30] Foreign Application Priority Data

Oct. 1, 1992 [IT] Italy ..... TO92A0800

[51] Int. Cl.[6] ..... A41H 43/00; A41H 1/00; B07C 9/00; D03D 3/02

[52] U.S. Cl. ..... 223/1; 209/656; 209/938; 28/142; 33/2 A

[58] Field of Search ..... 28/142; 209/586, 209/587, 656, 591, 938; 33/2 A; 223/75, 43, 1

[56] References Cited

U.S. PATENT DOCUMENTS

| | | | |
|---|---|---|---|
| 2,890,818 | 6/1959 | Harralson | 223/75 |
| 3,038,604 | 6/1962 | Müller | 209/586 |
| 3,349,905 | 10/1967 | Crawford | 209/586 |
| 3,613,883 | 10/1971 | Starbuck et al. | 209/591 |
| 3,708,065 | 1/1973 | Aull et al. | 209/586 |
| 3,918,586 | 11/1975 | Tyler et al. | 209/586 |
| 5,335,790 | 8/1994 | Geiger et al. | 209/656 |

FOREIGN PATENT DOCUMENTS

| | | | |
|---|---|---|---|
| 889130 | 12/1943 | France | 209/591 |
| 1567292 | 5/1990 | U.S.S.R. | 209/656 |
| 1505073 | 3/1978 | United Kingdom | 209/586 |

*Primary Examiner*—C. D. Crowder
*Assistant Examiner*—Bibhu Mohanty
*Attorney, Agent, or Firm*—Cohen, Pontani, Lieberman, Pavane

[57] ABSTRACT

A device for a stocking turning machine for automatically separating only partially turned stockings from completely turned stockings.

Each stocking which leaves the automatic stocking turning machine is conducted by a chute into a pneumatically operating ejection tube which bears two photocells with corresponding reflectors. The adjustable distance between the two photocells is such that when the stocking in question has been completely turned, its toe and the stocking welt simultaneously darken the two photocells. A cylinder is then actuated in such a manner that a guide chute which is connected to it assumes a deflection position shown in solid lines in the drawing, whereby the stocking falls into the container, whereupon the guide chute again returns into its starting position. If the stocking has not been completely turned, the two photocells are not simultaneously darkened; thus the cylinder is not actuated, the guide chute remains in the vertical position, and the stocking falls into the other container.

8 Claims, 1 Drawing Sheet

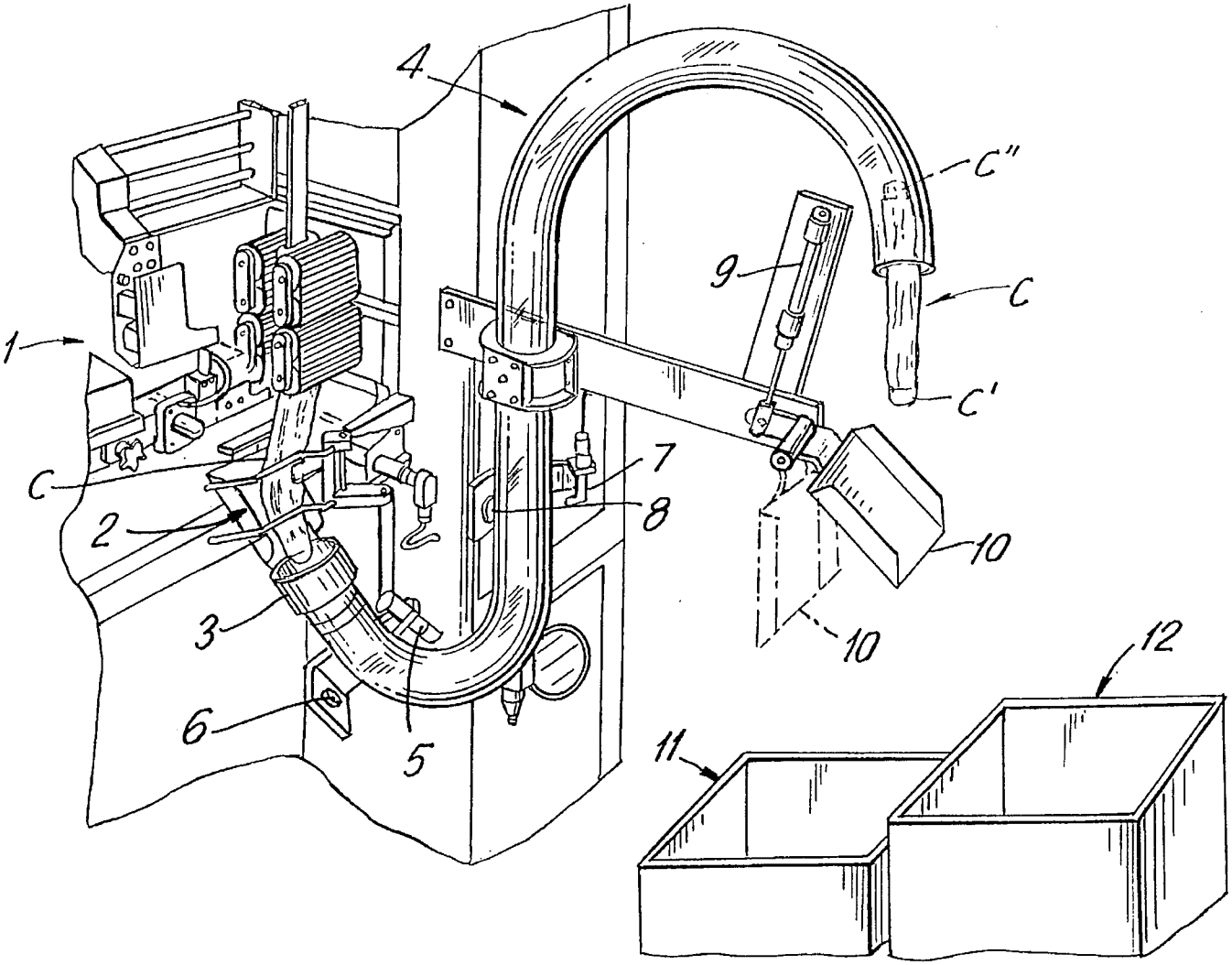
1
2
3
4
5
6
7
8
9
10
10
11
12
C
C'
C''

DEVICE FOR REMOVING MERELY PARTIALLY TURNED STOCKINGS ON A STOCKING TURNING MACHINE

BACKGROUND OF THE INVENTION

1. Field of the Invention

The present invention relates to a device for an automatic stocking turning machine which is able, without manual intervention, to separate completely turned stockings from ones which have only been partially turned.

2. Discussion of the Prior Art

Automatic stocking turning machines are known in which the stockings, after turning, are discharged downward and conducted over an oblique chute to the inlet opening of an ejector tube. Within said tube, the stockings are conveyed by a jet of air to the outlet opening of the tube, which opens in downward direction and is located above a collecting container into which the stockings fall after the turning.

Such stocking turning machines, one of which is described and shown by way of example in the applicant's Italian Patent Application No. 67 993 A/89 (WO 91/07540), operate relatively precisely and efficiently. Nevertheless, it can at times happen that a small and generally negligible number of stockings are turned only partially rather than completely, so that, at the outlet of the stocking turning machine, a section of the welt of the stocking still lies over the preceding section. It is therefore necessary carefully to observe the stockings arriving at the outlet of the stocking turning machine in order, in the event of an error, to effect manually the complete turning of the few stockings (generally less than 2% of the total number) which have not been completely turned in the stocking turning machine. This operation is absolutely necessary in order to make certain that incompletely turned stockings do not enter the following processing stations at which, in the event of the use of uncolored yarns, coloring is effected and/or the stockings are ironed before they are packed.

This problem is of importance, in particular, in the case of large production quantities (for example, on the order of magnitude of a few dozen million stockings a year), since then, even in the event of small percentages of incompletely turned stockings, the amount of additional manual work is great, which considerably increases the cost of production.

SUMMARY OF THE INVENTION

The object of the present invention is therefore to make it possible to dispense with the continuous visual observation and manual handling of the stockings which leave the stocking turning machine, in order in this way to reduce the cost of labor accordingly.

This object is achieved by a device for an automatic stocking turning machine fed by a looping machine, comprising:

measurement means for measuring the length of a stocking, said measurement means being arranged along the path of the stocking after turning the stocking;

deflection means for determining the path of transport of the turned stockings over one of two different alternative delivery paths depending on whether the stocking is completely or partially turned at the outlet of the stocking turning machine;

actuating means which are controlled by the measurement means and which actuate the deflection means in such a manner that the stocking is conducted over one or the other of the two alternatively delivery paths depending on whether the stocking has been turned completely or only partially. Advantageous further features include employing a device as described above, wherein the means for measuring consists of a sensor member which detects the passage of the stocking, a detecting member for detecting the duration of the actuation of the sensor member, as well as a comparison means for comparing a duration of the actuation of the sensor member with a predetermined calibration time which is adjustable as a function of the length of the stocking to be turned.

For the solution of this problem, use is made of the fact that completely turned stockings are longer in stretched condition than only partially turned stockings are. Thus, it is possible merely slightly to modify the outlet region of the traditional automatic stocking turning machine now in use.

BRIEF DESCRIPTION OF THE DRAWING

The sole FIGURE is a perspective showing of a device in accordance with the invention which is installed on a stocking turning machine in accordance with the aforementioned patent application (WO 91/07540).

DETAILED DESCRIPTION OF THE PREFERRED EMBODIMENTS

As shown in the sole figure, the stocking turning machine 1 of known construction has, below the delivery zone, a chute 2 over which the stockings C coming from the stocking turning machine 1 are conducted to the inlet opening 3 of an ejector tube 4. Within it, the individual stockings are conveyed in known manner by a jet of air to the outlet opening of the ejector tube 4, which is directed downwards. On the ejector tube 4, which is made of transparent plastic, there are adjustably fastened two pipe clamps, each of which bears a photocell 5, 7, with corresponding reflectors 6, 8 respectively. The distance between the two photocells 5 and 7 is each time so adjusted that it is equal to or somewhat less than the length of a stretched stocking C between toe C' and welt C".

When a completely turned stocking C comes into the ejector tube 4, both photocells 5 and 7 can be completely covered by it. In this way, a pulse is passed to a circuit (not shown) which gives off a control command to a cylinder 9 which is pivoted to a fixed support. When the cylinder 9 is actuated in this manner, its piston rod, by means of a lever, turns its guide chute (i.e. slide chute) 10 in such a manner that it swings below the outlet of the ejector tube 4 so that the completely turned stocking C falls into a container 12 placed below same.

If the two photocells 5 and 7 detect a stocking which has not been completely turned, the slide chute 10 remains in the vertically downward hanging position shown in dashed line, so that the defective stockings fall into a second container 11.

In addition to the embodiment which has been shown and described, changes are, of course, also possible without going beyond the scope of the inventive concept. Thus, for instance, the cylinder 9 may be actuated only when an incompletely turned stocking arrives in the ejector tube 4. In this way, one avoids having the slide chute 10 having to be swung so frequently, so that it generally retains the position shown in solid lines in which the completely turned stockings C fall into the container 12. Furthermore, it would be possible not to provide two sensor elements which respond to the passage of the stockings but rather to use only a single sensor element and to employ as parameter not the length of the completely turned stocking but the time which such a stocking requires in order to pass over a path which corresponds to its length. Furthermore, the stocking turning machine can also be developed differently than shown in the drawing. Instead of belts which rotate in opposite direction, pairs of rollers can be provided, the rollers of the lower pair having merely the task of delivering the stockings from the stocking turning machine.

I claim:

1. A device for sorting stockings in an automatic stocking turning machine fed by a looping machine, comprising:

measurement means for measuring the length of a stocking, said measurement mean being arranged along a path of transport of the stocking after turning the stocking;

an ejector tube for the passage of stockings therethrough, which defines the path of transport to have a first delivery path and a second delivery path;

deflection means for directing the turned stockings to one of the first and second delivery paths depending on whether the stocking is completely turned or only partially turned at the outlet of the stocking turning machine; and actuating means which are controlled by the measurement means and which actuate the deflection means in such a manner that the stocking is conducted over the first delivery path when the stocking is completely turned and conducted over the second delivery path when the stocking is only partially turned.

2. A device according to claim 1, wherein the means for measuring consists of a sensor member which detects passage of the stocking, a detecting member for detecting the duration of the actuation of the sensor member, as well as a comparison means for comparing a duration of the actuation of the sensor member with a predetermined calibration time which is adjustable as a function of the length of the stocking to be turned.

3. A device according to claim 1, wherein the measurement means consist of two sensor members for detecting the passage of the stocking which are at an adjustable distance apart which is at most the length of a completely turned stocking.

4. A device according to claim 2, wherein the sensor members for the detecting of the passage of the stocking consist of beam-detection members, which are connected to a control circuit.

5. A device according to claim 3, wherein the ejector tube has an upstream end where the stocking enters the ejector tube and a downstream end where the stocking exits the ejector tube, wherein two pipe clamps are attached to the ejector tube upstream of the downstream end, the clamps are adjustable with respect to their position, each clamp bears, diametrically opposite each other, one of the sensor members, each sensor member comprising a photocell and a corresponding reflector.

6. A device according to claim 5, wherein the downstream end of the ejector tube has a downwardly directed outlet and below the downwardly directed outlet at the downstream end of the ejector tube there is arranged, as the deflecting means, a guide chute which is swingable around a horizontal axis and is connected to a lever which is pivoted to a piston rod of a cylinder which is arranged on a fixed support, the guide chute being adapted to assume a vertical or an inclined position depending on whether the piston rod of the cylinder is retracted or extended from it, the position of the piston rod with respect to the cylinder being controlled by the pulses which the photocells give off to the control circuit.

7. A device according to claim 6, wherein the control circuit is so associated with the photocells that the control circuit is operable to push the piston rod out of the cylinder and thereby bring the guide chute into an inclined position when the two photocells are darkened simultaneously by a welt and toe of the stocking in passage through the ejector tube.

8. A device according to claim 6, wherein the control circuit is connected to the two photocells in a manner that when the photocells are simultaneously darkened by a welt and toe of the stocking in the ejector tube, the piston rod is retracted into the cylinder and the slide chute assumes a vertical position.

* * * * *